United States Patent [19]

Mallek et al.

[11] 4,277,362

[45] Jul. 7, 1981

[54] METHOD OF TREATING RADIOACTIVELY CONTAMINATED SOLVENT WASTE

[75] Inventors: Heinz Mallek; Werner Jablonski, both of Linnich-Tetz; Willi Plum, Stolberg, all of Fed. Rep. of Germany

[73] Assignee: Kernforschungsanlage Jülich Gesellschaft mit beschrankter Haftung, Jülich, Fed. Rep. of Germany

[21] Appl. No.: 919,739

[22] Filed: Jun. 27, 1978

[30] Foreign Application Priority Data

Jun. 29, 1977 [DE] Fed. Rep. of Germany ..... 2729325

[51] Int. Cl.[3] ..... G21F 9/08; G21F 9/14

[52] U.S. Cl. ..... 252/301.1 W; 110/219; 110/237; 110/238

[58] Field of Search ..... 252/301.1 W; 110/237, 110/238, 219; 261/94

[56] References Cited

U.S. PATENT DOCUMENTS

| | | | |
|---|---|---|---|
| 3,112,275 | 11/1963 | Pollock et al. | 252/301.1 W |
| 3,666,673 | 5/1972 | Knoll | 252/301.1 W |
| 3,708,508 | 1/1973 | Schulz | 252/301.1 W |
| 3,771,657 | 11/1973 | Gulyas et al. | 261/94 |
| 3,881,430 | 5/1975 | Katz | 110/238 |

*Primary Examiner*—Deborah L. Kyle

*Attorney, Agent, or Firm*—Becker & Becker, Inc.

[57] ABSTRACT

A method of and apparatus for treating radioactively contaminated solvent waste. The solvent waste is supplied to material such as peat, vermiculite, diaton, etc. This material effects the distribution or dispersion of the solvent and absorbs the foreign substances found in the solvent waste. Air or an inert gas flows through the material in order to pick up the solvent portions which are volatile as a consequence of their vapor pressure. The thus formed gas mixture, which includes air or inert gas and solvent portions, is purified in a known manner by thermal, electrical, or catalytic combustion of the solvent portions.

7 Claims, 1 Drawing Figure

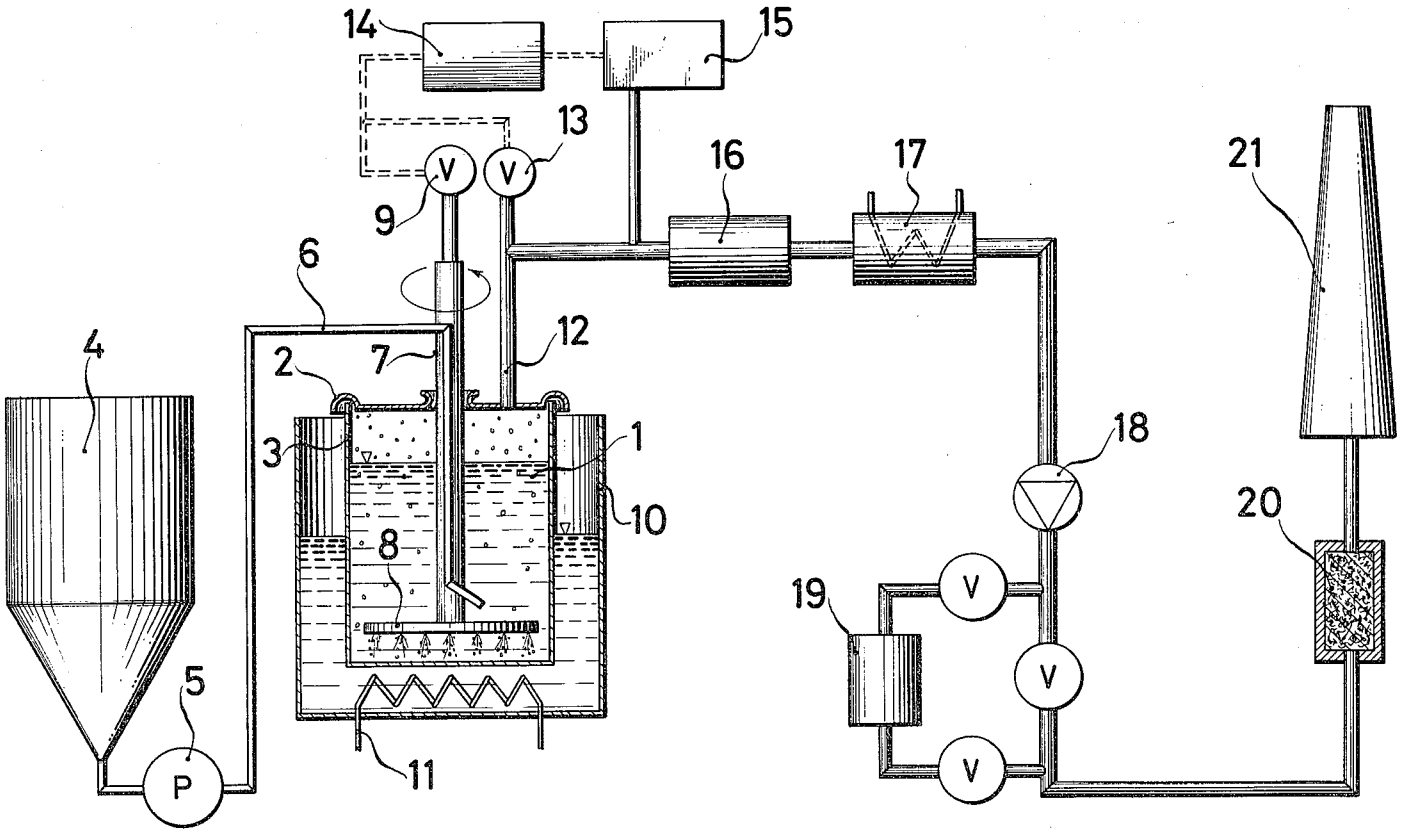
21
20
18
V
V
V
17
19
15
16
1
10
13
12
V
V
14
9
7
8
11
6
2
3
5
P
4

METHOD OF TREATING RADIOACTIVELY CONTAMINATED SOLVENT WASTE

The present invention relates to a method of treating radioactively contaminated solvent waste. The present invention also relates to an apparatus for carrying out this method.

In applied nuclear technology, radioactively contaminated solvent waste results, which must be treated in a suitable manner in order to be able to safely store the radioactive material. It is known to burn the solvent waste in furnace installations, if necessary as supplemental material. However, this has the drawback that the combustion chambers are largely contaminated by the radioactive materials. A further drawback is that portions of the radioactive materials are converted into gases as a result of the high combustion temperatures, so that the materials pass into the atmosphere as gases if they are not precipitated in colder vent pipes. Moreover, the burning of solvents containing foreign substances causes problems due to insufficient combustion control.

It is further known to absorb the solvent waste in suitable materials, such as diaton or vermiculite, and to harden them after mixing them with a suitable material, such as cement. However, this has the drawback that the thereby resulting product, which must finally be dumped or stored, has about four times as great a volume as the volume of the solvent which is to be stored.

It is therefore an object of the present invention to provide a method which makes it possible, even with the accumulation of different solvent wastes, to separate the radioactive materials in a safe way from the solvent portions, thereby concentrating the radioactive materials in a relatively small volume. The method should be economical, and should be carried out in an entirely automatic operation.

It is a further object of the present invention to provide an apparatus for practicing the method of the present invention.

These and other objects and advantages of the present invention will appear more clearly from the following specification in connection with the accompanying drawing, which shows one embodiment of the apparatus according to the present invention.

The method of treating radioactively contaminated solvent waste pursuant to the present invention is characterized primarily in that the solvent waste is supplied to a material such as peat, vermiculite, diaton, etc. This material effects the distribution or dispersion of the solvent and absorbs the foreign substances found in the solvent waste. Air or an inert gas flows through the material in order to pick up the solvent portions which are volatile as a result of their vapor pressure. The thus formed gas mixture, which comprises air or inert gas and solvent portions, is purified in a known manner by thermal, electrical, or catalytic combustion of the solvent portions.

For absorbing the radioactively contaminated solvent waste, any material can be used which offers the solvent a greatly increased vaporization surface and can absorb the solvent. Such a material guarantees that the air or inert gas stream flowing through the material will be extensively saturated with solvent vapor, thus taking with it a large proportion of the solvent. In this connection, in order to increase the vapor pressure of the solvent, it may be expedient to heat up the material which effects the distribution of the solvent waste to 30° to 50° C.

In contrast to the known methods, according to which the contaminated solvent waste is burned directly, with the method of the present invention the temperature provided for vaporizing the solvent is very low. Thus, an advantageous further feature of the method of the present invention is possible with a series of solvents, such as alcohols, esters, and ketones, and consists in that the foreign substances are bound by added materials, such as ion exchange material and the like, which are supplied to the material which absorbs the solvent waste. As a result of the thereby obtained increase in the decontamination factor, the method of the present invention is even more effective.

Since the gas mixture which is formed is extensively saturated with solvent vapors, it is expedient to add air to this gas mixture prior to the purification by combustion of the solvent portion to avoid explosions. The air supply, especially with fully automatic operations, is expediently controlled in such a way that the concentration of the solvent portion in the gas mixture is not more than half of the lower concentration limit of the combustible gas or vapor in the gas mixture at which the gas mixture can be exploded by being heated.

The method of the present invention is advantageously carried out with an apparatus which is characterized primarily by a sealable or closable receptacle provided for receiving the material which effects the distribution of the solvent waste. The receptacle has supply lines for supplying the solvent waste and the air or inert gas into the lower portion of the receptacle where the material is contained. The receptacle also has a pipe connection for carrying off the gas mixture out of the top portion of the receptacle. The apparatus is further characterized by a device for purifying the gas mixture. This device is located above the pipe connection which carries off the gas mixture and is connected with the receptacle. To heat up the material which is located in the receptacle for absorbing the solvent waste, a device is expediently provided which may for example comprise a further receptacle which is filled with water and is provided with a heating device. The first receptacle is located inside of this latter receptacle.

Pursuant to a further embodiment of the apparatus according to the present invention, the conduit provided for the supply of air or inert gas projects from above into the receptacle and empties at the bottom of the receptacle. In this way, if a distributing head is provided at the lower end of the conduit which projects into the receptacle, and if the conduit which projects into the receptacle is rotatably mounted and is connected with a drive for turning the conduit, then the absorbent material for the solvent waste can be stirred up. In this manner, a uniform distribution of the radioactive foreign substances in the absorbent material is achieved.

To mix air in the gas mixture which leaves the absorbent material, another conduit is provided which is connected with the conduit provided for carrying off the gas mixture. A valve for dosing or adding measured amounts of the air which is to be mixed in is expediently located in this new conduit. This valve is controlled by a device for regulating the quantity of air to be mixed in, so that the concentration of the solvent portion in the gas mixture provided for combustion can be kept below the intended concentration.

It may be expedient to provide a valve in the air or inert gas supply line. This makes it possible, by corresponding dosing of the air or inert gas introduced into the absorbent material, to adjust the solvent concentration in the gas mixture which is supplied to the combustion apparatus to a value which is suitable for an efficient combustion. In such a case, it is expedient to add a constant amount of air to the gas mixture prior to entry of the latter into the device for combustion.

After cooling the exhaust gas obtained during the combustion of the solvent portion, this exhaust gas is additionally purified before being released into the atmosphere. For this purpose, the known wet cleaning or washing method can be used, or filters, for example activated carbon filters, can also be used. The absorbent material, after the radioactive foreign substances contained therein are concentrated, is expediently provided for final storage in a known manner.

Referring now to the drawing in detail, a receptacle 3, which can be closed off by a lid 2, is provided for receiving the material 1 which effects the distribution or dispersion of the solvent waste. To supply the solvent waste which is stored in a storage tank 4, a dosing pump 5 and a supply line 6 are provided. The supply line 6 passes through the receptacle lid 2 and projects as far as the floor of the receptacle 3. To supply air or inert gas, a conduit 7 projects from above through the receptacle lid 2 and ends in a distributing head 8 which comprises a conduit piece which extends parallel to the floor of the receptacle and is provided with openings which are directed toward the bottom. The distributing head 8 is provided with openings on that side which faces the floor of the receptacle 3. Air or inert gas is forced through these openings into the receptacle. The conduit 7 is rotatably mounted in the lid 2 and is connected with a drive (not shown). By turning the conduit 7, and thereby also the distributing head 8, the absorbent material is moved during operation. In order to add the air or inert gas into the absorbent material in measured amounts, a valve 9 is provided.

The receptacle 3 is located in a water filled receptacle 10, in the lower portion of which is provided a heating device 11 for heating up the water.

To draw off the gas mixture, which comprises air or inert gas and solvent portions, a pipe connection 12 is additionally provided in the lid 2 for carrying off the gas mixture. Air is added to this carried off gas mixture by means of a valve 13. The setting of the valves 9 and 13 is selectively controlled by means of a control unit 14, which in turn is connected to a detector 15 which is connected with the withdrawal line for the gas mixture by a measuring conduit. The detector 15 serves to determine the concentration of the solvent portion in the gas mixture. Thethus formed rarefied gas mixture is supplied to an electric afterburner 16 for burning the combustible portions in the gas mixture. A gas condenser 17 follows the afterburner 16. The exhaust gases are then conveyed through an exhaust gas ventilator 18, a device 19 for washing the gases, and through an absolute filter 20 into a chimney 21. The filter 20 is an aerosol filter having a high extraction capacity, a so-called HEPA (High Efficiency Particulate Aerosol) filter.

In a plant of the type shown in the drawing, toluene contaminated with $C_{14}$ was treated. The receptacle was filled about three quarters with peat, into which air was conveyed. The thus formed gas mixture had a solvent portion of 6000 ppm, while the solvent portion in the exhaust gas was 1 ppm. The temperature of the water bath, in which the receptacle 3 was located, was about 30° C.

The present invention is, of course, in no way limited to the specific showing of the drawing, but also encompasses any modifications within the scope of the appended claims.

We claim:

1. A method of treating radioactively contaminated solvent waste including foreign substances and solvent portions which are volatile, which includes the steps of:

supplying said solvent waste to a first absorbent material which effects dispersion of the solvent and absorption of the foreign substances found in said solvent waste;

passing a gas selected from the group consisting of air and inert gas through said first absorbent material to pick up solvent portions which are volatile as a consequence of their vapor pressure so as to form a gas mixture; and purifying said gas mixture by combustion of said solvent portions.

2. A method according to claim 1, in which said first absorbent material is selected from the group consisting of peat, vermiculite, and diaton.

3. A method according to claim 1, in which said combustion is selected from the group consisting of thermal, electrical, and catalytic combustion.

4. A method according to claim 1, which includes the step of heating said first material to 30° to 50° C.

5. A method according to claim 1, which includes the step of adding a further material to said first absorbent material to bind said foreign substances.

6. A method according to claim 5, in which said further material comprises ion exchangers.

7. A method according to claim 1, which includes the step of adding air to said gas mixture prior to the combustion thereof.

* * * * *